US006881177B2

(12) United States Patent
An

(10) Patent No.: US 6,881,177 B2
(45) Date of Patent: Apr. 19, 2005

(54) HANDGRIP

(76) Inventor: Tae-jin An, Hana Apt. #201-1307, 341-14, Gajeong-2dong, Seo-Ku, Incheon City (KR)

( * ) Notice: Subject to any disclaimer, the term of this patent is extended or adjusted under 35 U.S.C. 154(b) by 7 days.

(21) Appl. No.: 10/399,723

(22) PCT Filed: Oct. 17, 2001

(86) PCT No.: PCT/KR01/01742

§ 371 (c)(1),
(2), (4) Date: Apr. 17, 2003

(87) PCT Pub. No.: WO02/32509

PCT Pub. Date: Apr. 25, 2002

(65) Prior Publication Data

US 2004/0003687 A1 Jan. 8, 2004

(30) Foreign Application Priority Data

Oct. 18, 2000 (KR) ..... 2000/29039
Jul. 9, 2001 (KR) ..... 2001/40942

(51) Int. Cl.[7] ..... A63B 24/00
(52) U.S. Cl. ..... 482/49; 482/126; 482/121
(58) Field of Search ..... 482/49, 126, 121, 482/122, 128, 44–50, 907, 127; 601/40

(56) References Cited

U.S. PATENT DOCUMENTS 3,349,621 A * 10/1967 Mullen
4,553,746 A 11/1985 Lee
5,060,934 A 10/1991 Winston
5,267,929 A * 12/1993 Chen
5,409,436 A 4/1995 Chang
5,690,596 A * 11/1997 Parker
5,713,822 A * 2/1998 Newman et al.
6,319,175 B1 * 11/2001 Wu

FOREIGN PATENT DOCUMENTS

JP 405329228 A * 12/1993 ..... 482/49

* cited by examiner

*Primary Examiner*—Jerome W. Donnelly
(74) *Attorney, Agent, or Firm*—Cantor Colburn LLP

(57) ABSTRACT

Disclosed is a handgrip 1 comprising a pair of grips 20 and 20' rotatably combined each other by means of a shaft 10 and capable of moving toward and away from each other; a spring member 40 having two combining ends 40' and 40" respectively combined to the grips 20 and 20', and restoring the grips 20 and 20' to move away from each other; and an adjustment part 50 adjusting a distance between the shaft 10 and at least one of the combining ends 40' and 40" of the spring member 40. With this configuration, the present invention provides a handgrip 1 having an adjustable elasticity structure.

3 Claims, 9 Drawing Sheets

HANDGRIP

FIELD OF THE INVENTION

The present invention relates in general to a handgrip, and more particularly, to a handgrip having a variable elasticity structure.

BACKGROUND ART

A handgrip is a kind of sports equipment for strengthening muscle of a hand and a forearm. The handgrip is not only handy to treat and carry but also is inexpensive, and thus it can be widely used in irrespective of age or sex.

To use the handgrip, a user grips a pair of grips thereof, and presses repeatedly the pair of grips to become mutually closer, thereby strengthening the muscle of the hand and the forearm. At this time, the pair of grips returns to the original position by elasticity of a spring.

However, in the conventional handgrip, because the spring giving the pair of grips elasticity is fixed at a given place, the handgrip has only one level of elasticity. Therefore, it is necessary to individually select, a handgrip suitable for a grasping force of a user.

Therefore, if the level of elasticity of the handgrip can be simply adjusted, it is possible to select and use one handgrip regardless of the grasping force of a user.

DISCLOSURE OF INVENTION

Accordingly, the present invention has been made keeping in mind the above-described shortcoming and user's need, and an object of the present invention is to provide a handgrip having an adjustable elasticity structure.

This and other objects of the present invention may be accomplished by the provision of a handgrip comprising a pair of grips rotatably combined each other by means of a shaft and capable of moving toward and away from each other; a spring member having both combining ends respectively combined to the grips, and restoring the grips to move away from each other; and an adjustment part adjusting a distance between the shaft and at least one of the combining ends of the spring member.

Preferably, the handgrip further comprises a pair of working arms respectively extended from the grips and capable of moving toward and away from each other corresponding to the movement of the pair of grips.

Preferably, the adjustment part is comprised of a rotating member combined to at least one of the pair of working arms so as to move rotatably in the longitudinal direction of the working arm; and a movable block to which one of the combining ends of the spring member and the rotating member and capable of moving in the longitudinal direction of the rotating member corresponding to the rotation of the rotating member.

Preferably, one of the working arms in which the rotating member is accommodated is of a pipe shape, and has a guiding slot provided along the longitudinal direction of the rotating member formed on an outer surface.

Preferably, the adjustment part is comprised of a plurality of pin accommodating parts provided at one of the working arms and spaced from each other with a predetermined interval; and a combining pin selectively combining one of the combining ends of the spring member to one of the pin accommodating parts.

BRIEF DESCRIPTION OF DRAWINGS

The present invention will be better understood and its various objects and advantages will be more fully appreciated from the following description taken in conjunction with the accompanying drawings, in which.

MODES FOR CARRYING OUT THE INVENTION

Figure 1:
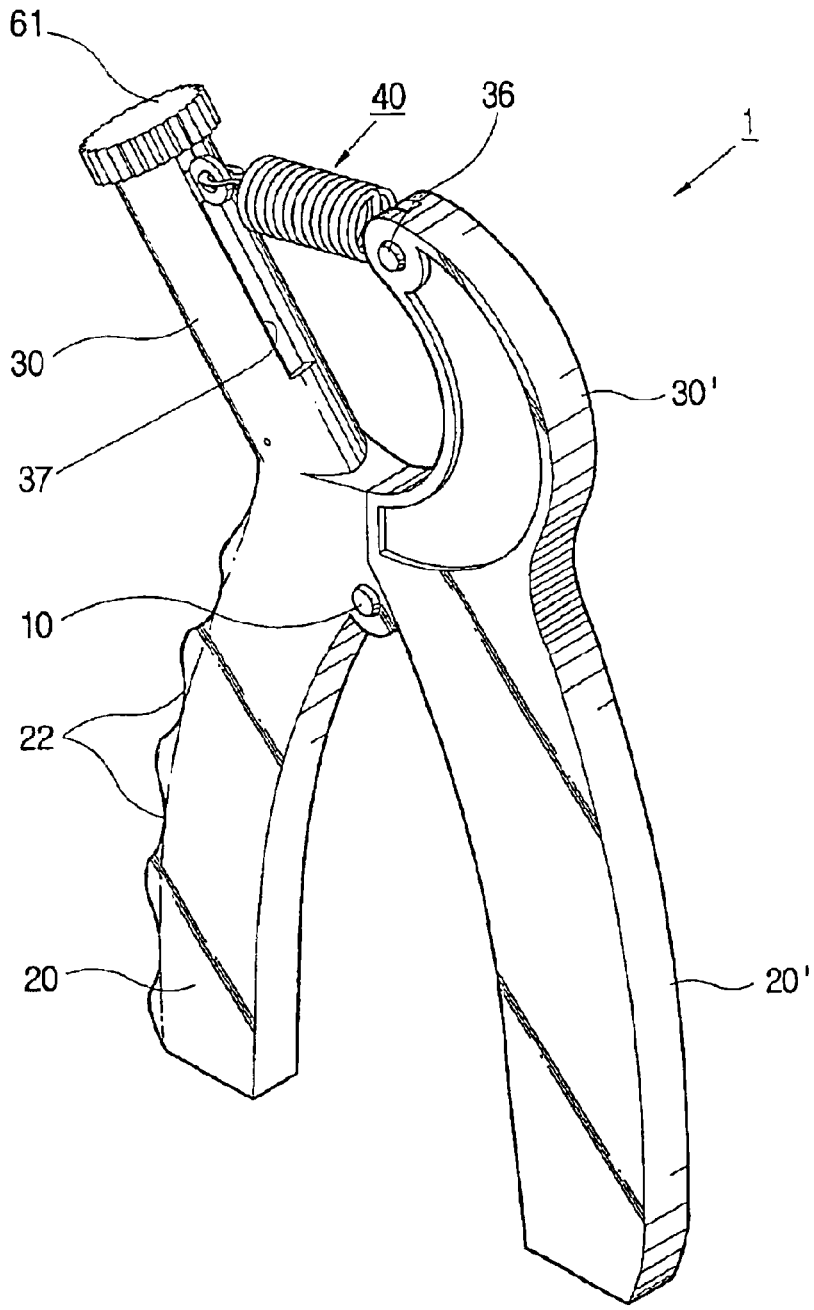
FIG. 1 is a perspective view of a handgrip according to a first embodiment of the present invention.

Preferred embodiments of the present invention will be described in more detail with reference to the accompanying drawings. In second through forth embodiments only parts distinguished from a first embodiment will be described, and reference numerals will be differently given according to the embodiments.

Figure 2:
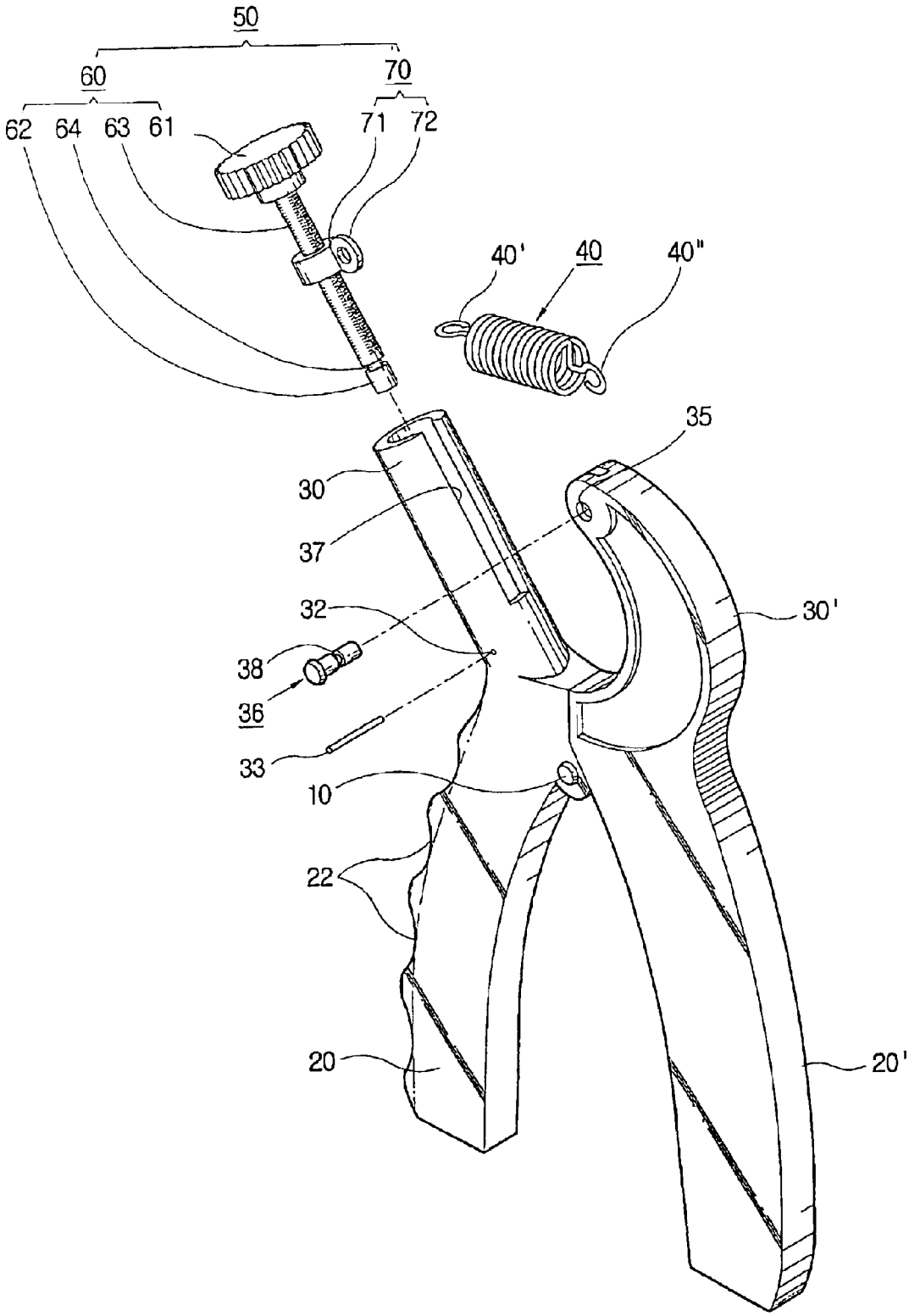
FIG. 2 is an exploded perspective view of the handgrip of FIG. 1.

As shown in FIGS. 1 and 2, a handgrip 1 according to the first embodiment of the present invention comprises a pair of grips 20 and 20' rotatably combined each other by means of a shaft 10 and capable of moving toward and away from each other, a pair of working arms 30 and 30' capable of moving toward and away from each other corresponding to movement of the pair of grips 20 and 20', and a spring member 40 having both combining ends 40' and 40" respectively combined to the working arms 30 and 30' and restoring the grips 20 and 20' to move away from each other.

The grips 20 and 20' are curved inwardly for easy grasp. On one of the grips 20 and 20', for example, on the grip 20 is provided a grip part 22 being of a groove shape for putting four fingers except thumb thereon. However, the grips 20 and 20' may be not curved but straight. Further, a rubber pad (not shown) may be adhered to the grip part 22 in order to prevent slipping.

The working arms 30 and 30' are respectively extended from the grips 20 and 20', and move toward and away from each other corresponding to the movement of the grips 20 and 20'. That is, the working arms 30 and 30' move away from each other according as the grips 20 and 20' move toward each other, whereas the working arms 30 and 30' move toward each other according as the grips 20 and 20' move away from each other. Hereinafter, for the convenience of description, the working arms 30 being of a pipe shape and shown at left side in FIG. 1 will be called a first working arm 30, and the other one will be called a second working arm 30'.

As shown in FIG. 2, between the first and second working arms 30 and 30' are provided the spring member 40. The spring member 40 has both the combining ends 40' and 40" respectively combined to the working arms 30 and 30', and restoring the working arms 30 and 30' to move toward each other when the grips 20 and 20' move away from each other.

Between the spring member 40 and the first working arm 30 is provided an adjustment part 50 by which the first combining end 40' of the spring member 40 varies it's position in the longitudinal direction of the first working arm 30, thereby adjusting the elastic force thereof.

The adjustment part 50 includes a rotating member 60 partially accommodated in and rotatably combined to the first working arm 30, and a movable block 70 to which the first combining end 40' of the spring member 40 and the rotating member 60 are connected and which is capable of moving in the longitudinal direction of the rotating member 60 corresponding to the rotation of the rotating member 60.

The rotating member 60 is comprised of a knob 61 exposed to the outside so as to be controlled by a user, an insertion part 62 inserted into the end of the first working arm 30 adjacent to the shaft 10, a screw rod 63 forming a screw thread thereon and connecting the knob 61 with the insertion part 62, and a groove part 64 formed on the circumference thereof between the insertion part 62 and the screw rod 63. On the groove part 64 is disposed a pin block 33. Thus, the pin block 33 is inserted through a pin hole 32 provided on the first working arm 30 so as to be disposed on the groove part 64, and therefore the rotating member 60 can be rotated in place.

The movable block 70 is comprised of a movable part 71 screw-combined to the screw rod 63 and capable of moving in the longitudinal direction of the screw rod 63 corresponding to rotating of the rotating member 60, and a combining part 72 extended from the movable part 71 and combined to the first combining end 40' of the spring member 40. As shown in FIG. 2, the combing part 72 is of a through hole shape, but it may be of a hook shape.

Outside the first working arm 30 is provided a guiding slot 37 for guiding the combining part 72 combined with the first combining end 40' of the spring member 40.

In a free end of the second working arm 30' is provided a pin accommodating hole 35. In the pin accommodating hole 35 is inserted a pin 36 fixing the second combining end 40" of the spring member 40 at the free end of the second working arm 30'. On the side of the pin 36 is formed a groove 38 preventing the second combining end 40" of the spring member 40 from a breakaway.

With this configuration, in the handgrip 1 according to the first embodiment of the present invention, the process of adjusting the level of the elastic force will be described hereinbelow, with reference to FIGS. 3 and 4.

Figure 3:
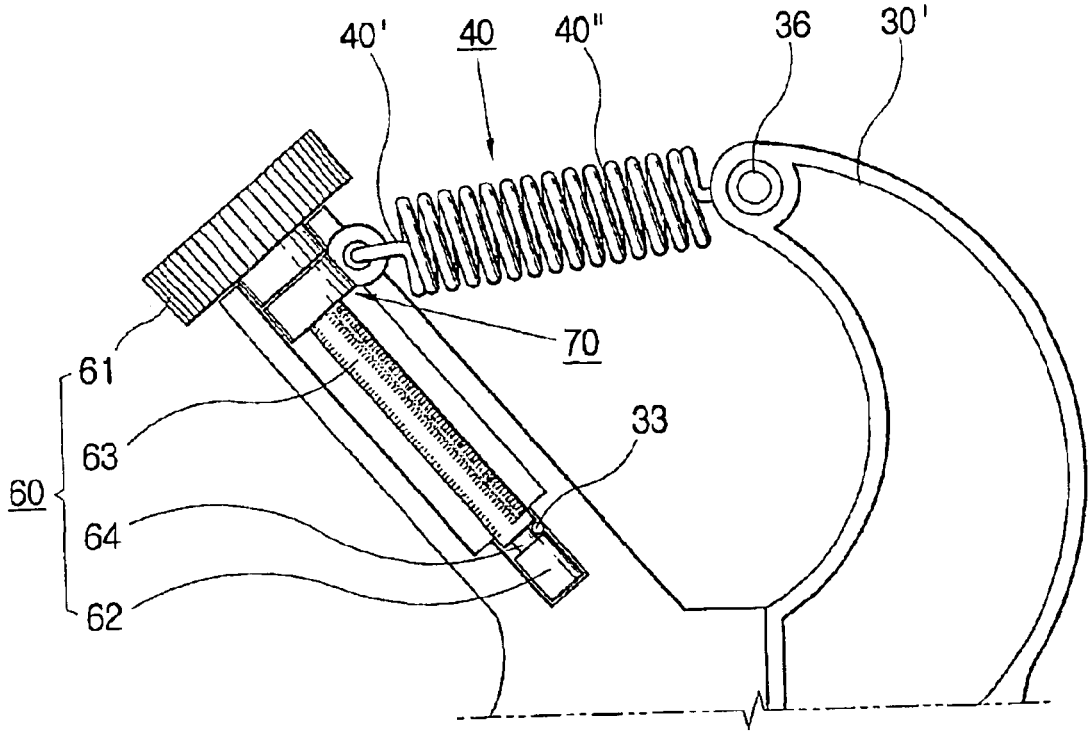
FIGS. 3 and 4 illustrate a usage of the handgrip of FIG. 1.

In the case that a person having a strong grasping force like an adult man uses the handgrip 1, as shown in FIG. 3, the person rotates the knob 61 of the rotating member 60 so as to make the movable block 70 move to the knob 61 in the longitudinal direction of the screw rod 63. Then, the first combing end 40' of the spring member 40 combined to the combing part 72 of the movable block 70 also moves to the knob 61. At this time, because the first combining end 40' of the spring member 40 is most distant from the shaft 10, the handgrip 1 can have a high elastic force.

Figure 4:
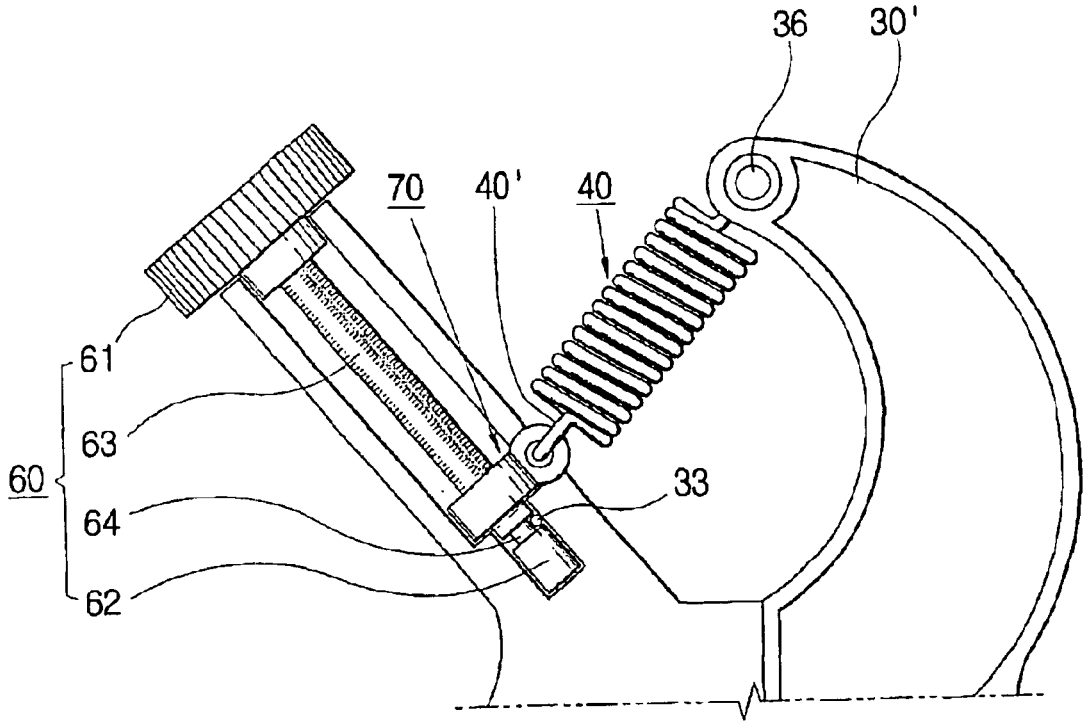

On the other hand, in the case that a person having weak grasping force like a child uses the handgrip 1, as shown in FIG. 4, the person rotates the knob 61 in the direction reverse to the above direction so as to make the movable block 70 move to the insertion part 62. Then, the first combing end 40' of the spring member 40 combined to the combing part 72 of the movable block 70 also moves to the insertion part 62. At this time, because the first combining end 40' of the spring member 40 is closest to the shaft 10, the handgrip 1 can have a low elastic force.

As described above, according to the first embodiment of the present invention, the level of the elastic force of the handgrip 1 can be simply adjusted by rotating the knob 61. Thus, by suitably adjusting the elastic force of the handgrip 1, a user can use the handgrip 1 conveniently according to his/her grasping force.

Figure 5:
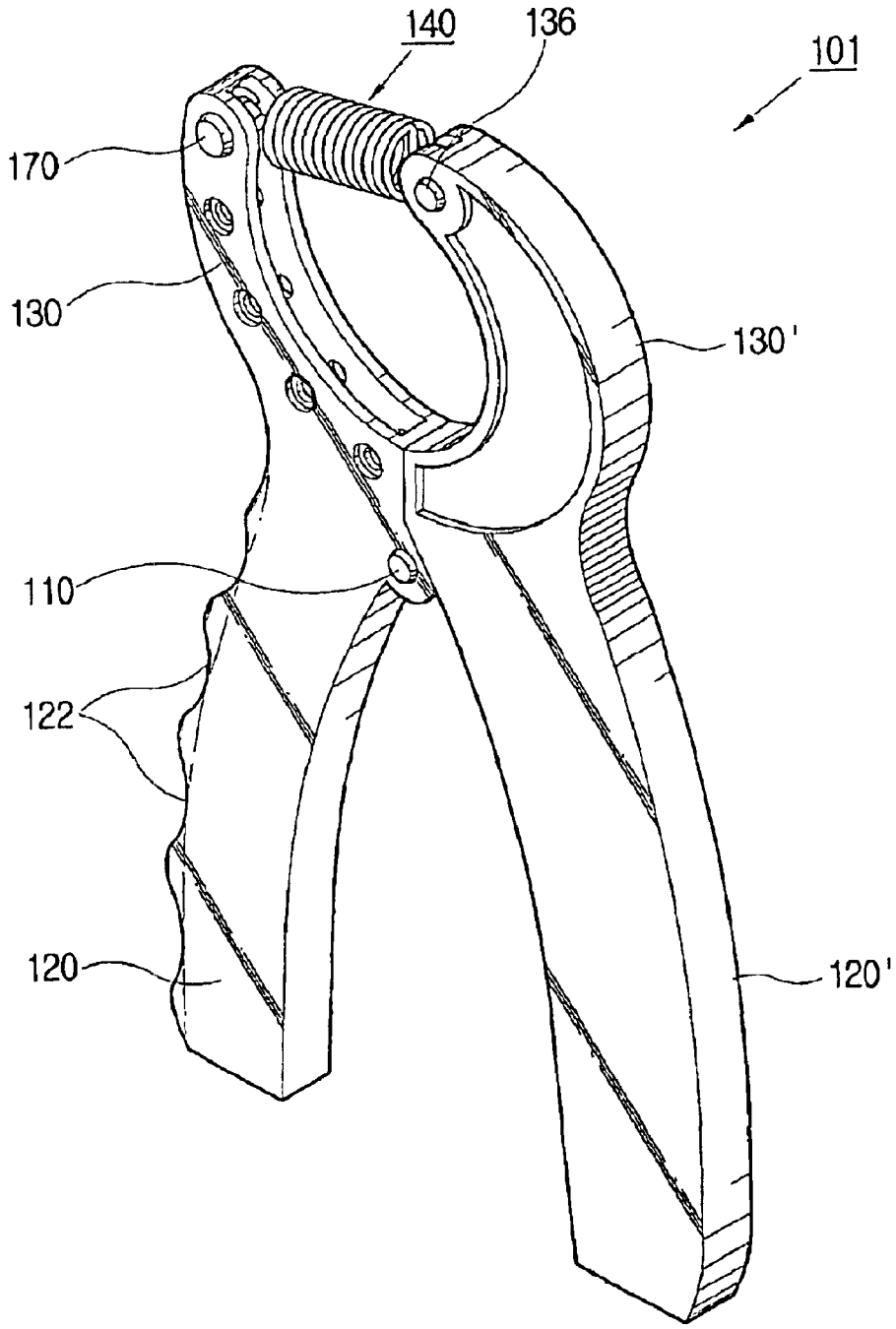
FIG. 5 is a perspective view of a handgrip according to a second embodiment of the present invention.
Figure 6:
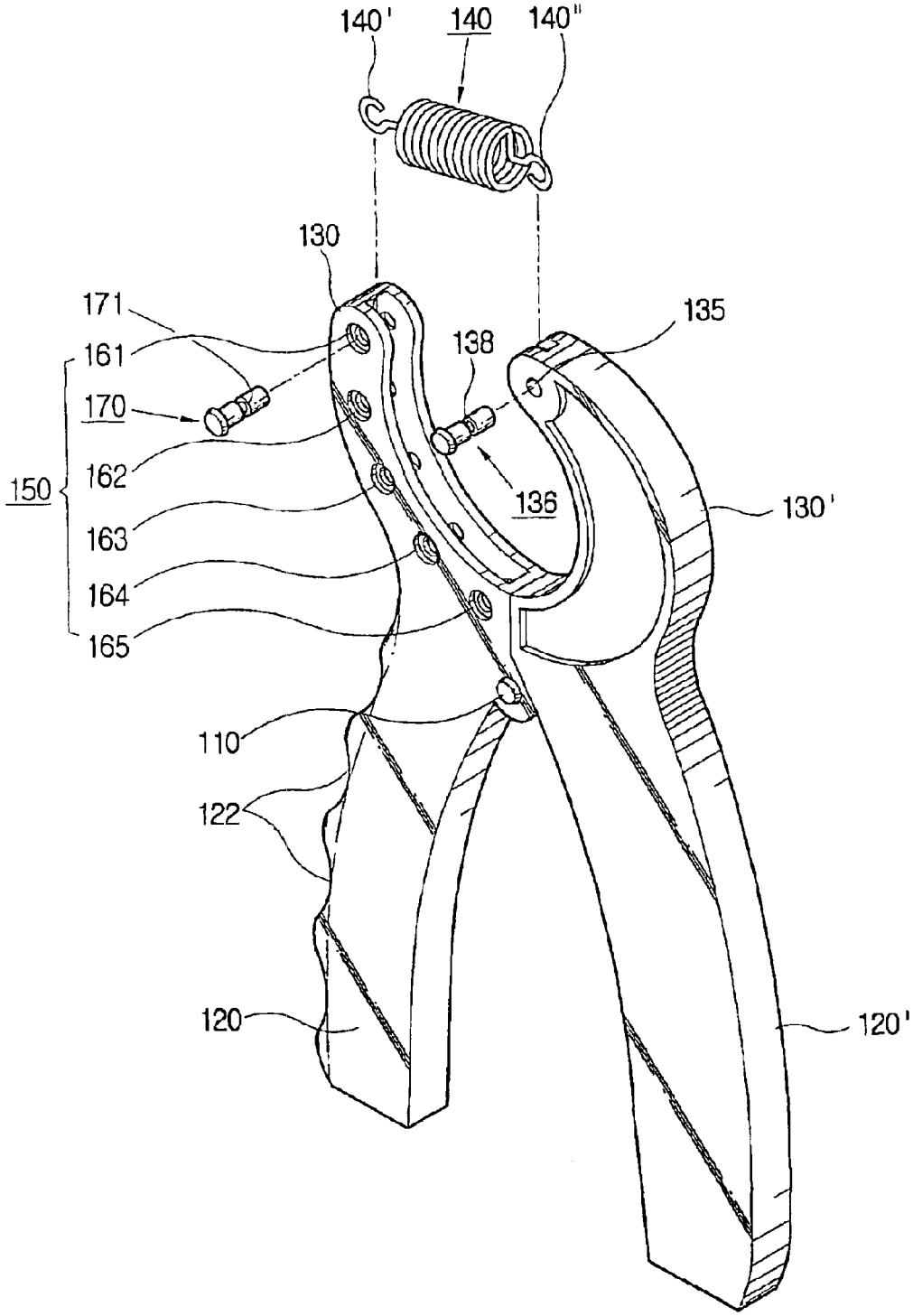
FIG. 6 is an exploded perspective view of the handgrip of FIG. 5.
Figure 7:
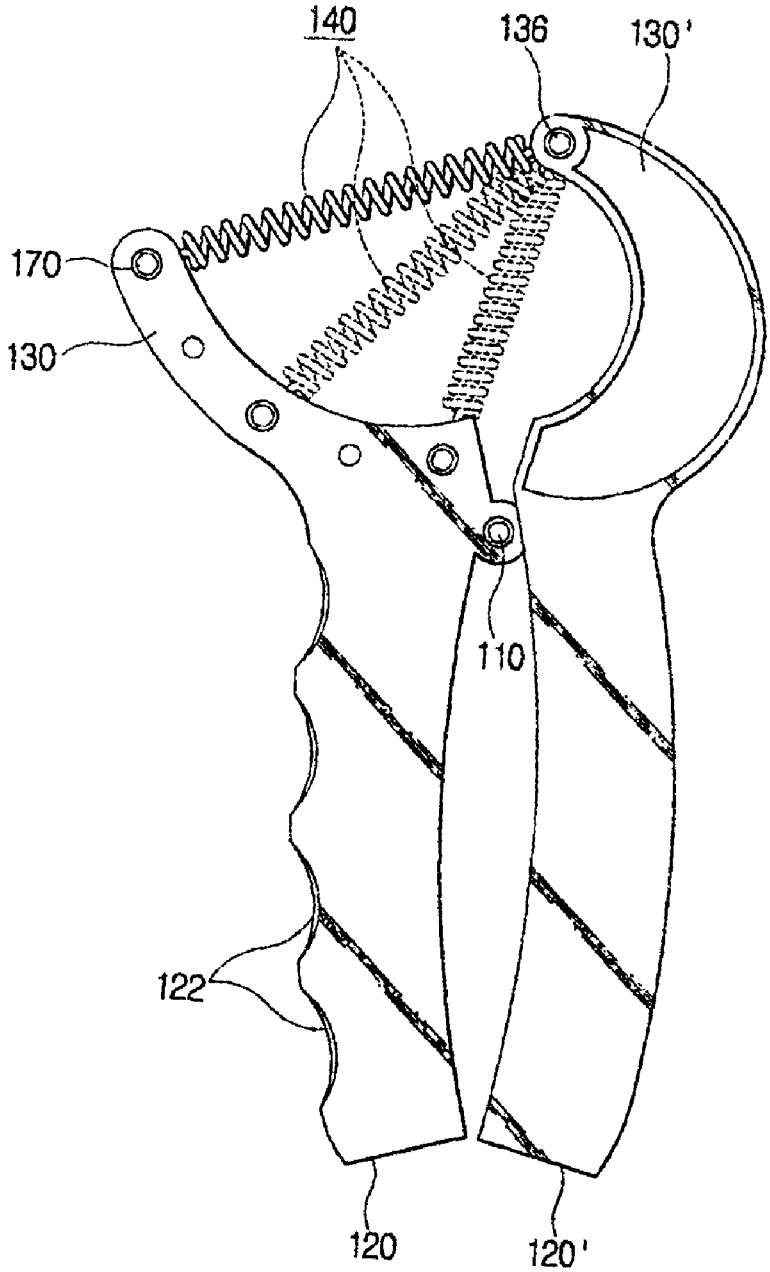
FIG. 7 illustrates the state that the level of elasticity varies in the handgrip of FIG. 5.

As shown in FIGS. 5 through 7, a handgrip 101 according to the second embodiment of the present invention comprises an adjustment part 150. Hereinafter, elements of the second embodiment same as those of the first embodiment will be given only different reference numerals, and repetitive descriptions thereof will be omitted as necessary.

As shown in FIGS. 5 and 6, the adjustment part 150 according to the second embodiment of the present invention is comprised of a plurality of pin accommodating parts 161 through 165 provided at a first working arm 130 and spaced from each other with a predetermined interval, and a combining pin 170 selectively combining a first combining end 140' of a spring member 140 to one of the pin accommodating parts 161 through 165.

The first combining end 140' of the spring member 140 is of a hook shape for hooking the combining pin 170. Corresponding to the hook shaped end, on the side of the combining pin 170 is formed a groove 171 preventing the first combining end 140' of the spring member 140 from a breakaway.

The second working arm 140" of the spring member 140 is fixed at a free end of the second working arm 130'. In order to fix the second working arm 140", in the free end of the second working arm 130' is provided a pin accommodating hole 135, and a pin 136 is inserted in the pin accommodating hole 135. At this time, on the side of the pin 136 is formed a groove 138 preventing the second combining end 140" of the spring member 140 from a breakaway.

With this configuration, in the handgrip 101 according to the second embodiment of the present invention, the process of adjusting the level of the elastic force will be described hereinbelow, with reference to FIG. 7.

In the case that a person having strong grasping force like an adult man uses the handgrip 101, the person inserts the combining pin 170 in the highest pin accommodating part 161 among the plurality of pin accommodating parts 161, and fixes the first combining end 140' of the spring member 140 on the groove 171 of the combining pin 170. At this time, because the first combining end 140' of the spring member 140 is most distant from the shaft 110, the handgrip 101 can have a high elastic force.

On the other hand, in the case that a person having a weak grasping force like a child uses the handgrip 101, the person inserts the combining pin 170 in the lowest pin accommodating part 165 among the plurality of pin accommodating parts 161, and fixes the first combining end 140' of the spring member 140 on the groove 171 of the combining pin 170. At this time, because the first combining end 140' of the spring member 140 is closest to the shaft 110, the handgrip 101 can have a low elastic force.

As described above, according to the second embodiment of the present invention, the level of the elastic force of the handgrip 1 can be simply adjusted by selectively inserting the combining pin 170 in the plurality of pin accommodating parts 161 through 165.

In the above described first and second embodiments, to adjust the level of the elastic force, the distances between the shafts 10 and 110 and the first combining ends 40' and 140' of the spring members 40 and 140 are varied. However, distances between the shafts 10 and 110 and the second combining ends 40" and 140" of the spring members 40 and 140 may be varied so as to adjust the level of the elastic force more precisely.

Further, in the above described first and second embodiments, the handgrips 1 and 101 employ the extension spring members 40 and 140 for adjusting the elastic force thereof. However, compression spring members 240 and 340 may be employed for adjusting the elastic force. Third and fourth embodiments employing the compression spring members 240 and 340 are briefly illustrated in FIGS. 8 and 9, respectively.

Figure 8:
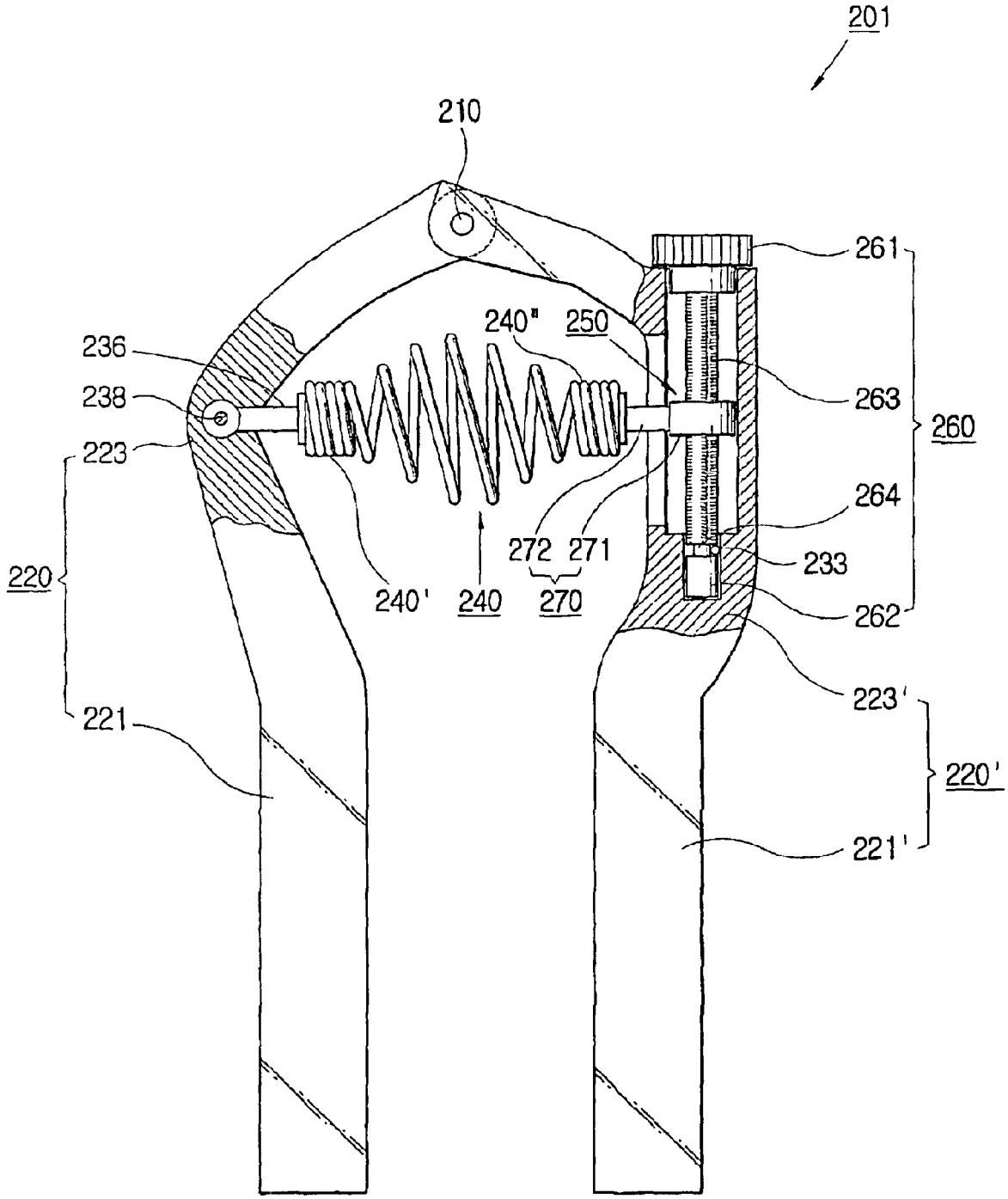
FIGS. 8 and 9 are sectional views of handgrips according to third and fourth embodiments of the present invention, respectively.

As shown in FIG. 8, a handgrip 201 according to the third embodiment of the present invention comprises a pair of grips 220 and 220' rotatably combined each other by means of a shaft 210 and capable of moving toward and away from each other, and a spring member 240 provided between the grips 220 and 220' and restoring the grips 220 and 220' to move away from each other. In the third embodiment, the compression spring is employed as the spring member 240.

The shaft 210 is provided at the junction of the ends of the grips 220 and 220'. The grips 220 and 220' are curved inwardly surrounding the shaft 210. One end of the grips 220 and 220' supports the other end, thereby keeping the grips 220 and 220' at a predetermined angle. Hereinafter, the grip shown at a left side in FIG. 1 will be called a first grip 220, and the other one will be called an second grip 220'.

The first grip 220 is comprised of a grip part 221 and a curved part 223 having a predetermined curvature. Inside the curved part 223 is provided a hanging projection 236 in which a first combining end 240' of the spring member 240 is inserted. The hanging projection 236 is partially inserted in the curved part 223, and rotatably supported by a pin 238. The other part of the hanging projection 236 which is not inserted in the curved part 223 is exposed to the outside, and therefore the hanging projection 236 can rotate with a predetermined angle by interlocking with the rotation of the spring member 240.

Herein, while a distance between the shaft 210 and the second combining end 240 of the spring member 240 is changed in order to adjust the level of the elastic force, the distance between the grips 220 and 220' may become narrower spontaneously. To prevent this problem, it is desirable that a position of the hanging projection 236 is provided in symmetry with a movable block 270 provided on a screw rod 263 with respect to the shaft 210.

The second grip 220' is comprised of a grip part 221', and a straight part 223' extended from the grip part 221 in parallel with the grip part 221. Between the straight part 223' and the spring member 240 is provided an adjustment part 250 by which the level of the elastic force of the handgrip 201 can be adjusted. Because the adjustment part 250 shown in FIG. 8 has the same configuration as that of the adjustment part 50 of the first embodiment (see FIG. 2), the description thereof will be omitted.

With this configuration, in the handgrip 1 according to the third embodiment of the present invention, the process of adjusting the level of the elastic force will be described hereinbelow.

In the case that a person having a strong grasping force like an adult man uses the handgrip 201, the person rotates a knob 261 of the rotating member 260 so as to make the movable block 270 move to the insertion part 262 in the longitudinal direction of the screw rod 263. Then, the second combing end 240" of the spring member 240 combined to the combing part 272 of the movable block 270 also moves to the insertion part 262. At this time, because the second combining end 240" of the spring member 240 is most distant from the shaft 210, the handgrip 201 can have a high elastic force.

On the other hand, in the case that a person having a weak grasping force like a child uses the handgrip 201, the person rotates the knob 261 in the direction reverse to the above direction so as to make the movable block 270 move to the knob 261. Then, the second combing end 240" of the spring member 240 combined to the combing part 272 of the movable block 270 also moves to the knob 261. At this time, because the second combining end 240" of the spring member 240 is closest to the shaft 210, the handgrip 1 can have a low elastic force.

As described above, according to the third embodiment of the present invention, the level of the elastic force of the handgrip 201 can be simply adjusted by rotating the knob 261.

Figure 9:
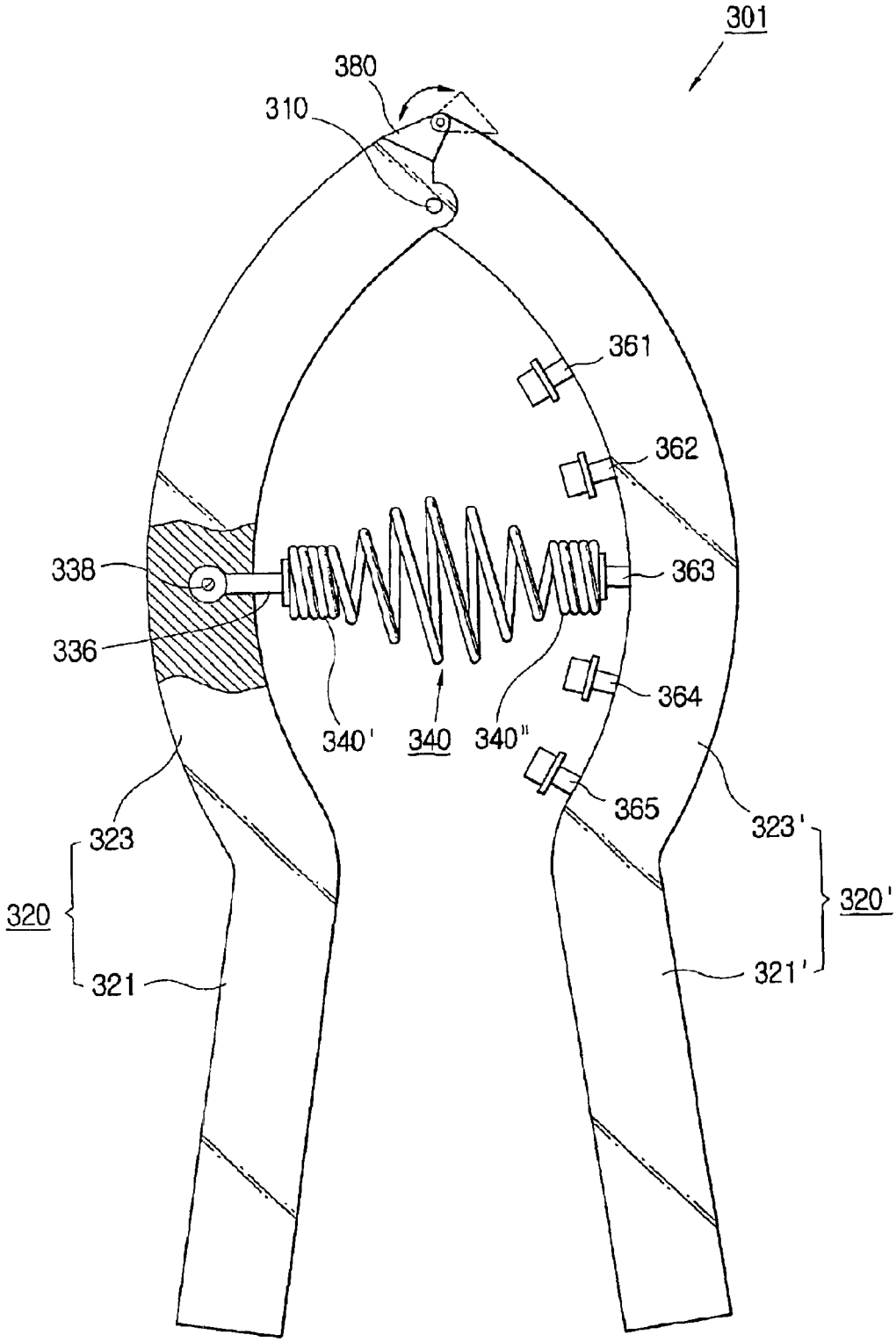

As shown in FIG. 9, a handgrip 301 according to the fourth embodiment of the present invention comprises a pair of grips 320 and 320' rotatably combined each other by means of a shaft 310 and capable of moving toward and away from each other, and a spring member 340 provided between the grips 320 and 320' and restoring the grips 320 and 320' to move away from each other. In the fourth embodiment, a compression spring is also employed as the spring member 340.

The pair of grips 320 and 320' is comprised of grip parts 321 and 321', and curved parts 323 and 323' having a predetermined curvature and being opposite each other. The spring member 340 has a pair of combining ends 340' and 340" to be respectively combined to the pair of curved parts 323 and 323'.

In the fourth embodiment of the present invention, a plurality of spring holders 361 through 365 are employed for adjusting the level of the elastic force, which are selectively combined to the second combining end 340" of the spring member 340. With this configuration, the second combining end 340" of the spring member 340 is combined to one of the spring holders 361 through 365 provided on the curved part 323' of the second grip 320', and the first combining end 340' is combined to a hanging projection 336 provided on the curved part 323 of the first grip 320, thereby having the same effect on adjusting the level of the elastic force as in the above described embodiments.

At this time, it is desirable that the hanging projection 336 is positioned at a level perpendicular to a line that links the spring holders 361 through 365.

In the fourth embodiment of the present invention, a stopper 380 is rotatably provided at the end of the curved part 323' of the second grip 320'. The stopper 380 is inserted in the end of the curved part 323 of the first grip 320.

Thus, if the stopper 380 is removed from the curved part 323 of the first grip 320, the pair of grips 320 and 320' moves away from each other because of tension of the spring member 340. At this time, the second combining end 340" of the spring member 340 can be inserted in one of the spring holders 361 through 365, and then the stopper 380 is inserted in the end of the curved part 323 of the first grip 320 so as to keep the pair of grips 320 and 320' at a predetermined angle.

When the second combining end 340" of the spring member 340 is inserted in the spring holder 365, the elastic force becomes maximum, and when the second combining end 340" of the spring member 340 is inserted in the spring holder 361, the elastic force becomes minimum.

As described above, according to the fourth embodiment of the present invention, the level of the elastic force of the handgrip 201 can be simply adjusted by selectively inserting the second combining end 340" of the spring member 340 in the plurality of spring holder 361 through 365.

As described above, the present invention provides a handgrip having an adjustable elasticity structure.

Although the preferred embodiments of the present invention have been disclosed for illustrative purpose, those skilled in the art will appreciate that various modifications, additions and substitutions are possible, without departing from the scope and spirit of the invention as disclosed in the accompanying claims.

What is claimed is:

1. A handgrip comprising:

a pair of grips rotatably combined each other by means of a shaft and capable of moving toward and away from each other;

a spring member having both combining ends respectively combined to the grips, and restoring the grips to move away form each other;

an adjustment part adjusting a distance between the shaft and at least one of the combining ends of the spring member; and a pair of working arms respectively extended from the grips and capable of moving toward and away from each other corresponding to the movement of the pair of grips, wherein the adjustment part includes:

a rotating member combined to at least one of the pair of working arms so as to move rotatably in the longitudinal direction of the working arm; and a movable block to which one of the combining ends of the spring member and the rotating member and capable of moving in the longitudinal direction of the rotating member corresponding to the rotation of the rotating member.

2. The handgrip according to claim 1, wherein one of the working arms in which the rotating member is accommodated is of a pipe shape, and has a guiding slot provided along the longitudinal direction of the rotating member formed on an outer surface.

3. A handgrip comprising:

a pair of grips rotatably combined each other by means of a shaft and capable of moving toward and away from each other;

a spring member having both combining ends respectively combined to the grips, and restoring the grips to move away form each other;

an adjustment part adjusting a distance between the shaft and at least one of the combining ends of the spring member, and a pair of working arms respectively extended from the grips and capable of moving toward and away from each other corresponding to the movement of the pair of grips, wherein the adjustment part includes:

a plurality of pin accommodating parts provided at one of the working arms and spaced from each other with a predetermined interval; and a combining pin selectively combining one of the combining ends of the spring member to one of the pin accommodating parts.

* * * * *